US006641220B2

(12) United States Patent
Clegg

(10) Patent No.: US 6,641,220 B2
(45) Date of Patent: Nov. 4, 2003

(54) HEAD SUPPORTING DEVICE

(76) Inventor: Norman Dorrien Stuart Clegg, 73A Waterfall Ave., Craighall (ZA)

( * ) Notice: Subject to any disclaimer, the term of this patent is extended or adjusted under 35 U.S.C. 154(b) by 0 days.

(21) Appl. No.: 10/061,742

(22) Filed: Feb. 6, 2002

(65) Prior Publication Data

US 2002/0113482 A1 Aug. 22, 2002

(30) Foreign Application Priority Data

Feb. 6, 2001 (ZA) ..... 2001/1015

(51) Int. Cl.[7] ..... A47C 7/38
(52) U.S. Cl. ..... 297/397; 5/636
(58) Field of Search ..... 297/397, 391; 5/636, 639, 645

(56) References Cited

U.S. PATENT DOCUMENTS 3,388,408 A * 6/1968 Blaney ..... 5/636
4,114,948 A * 9/1978 Perkey ..... 297/397
4,206,945 A * 6/1980 Kifferstein ..... 297/397
5,567,015 A * 10/1996 Arias ..... 297/397
5,689,844 A * 11/1997 Liu ..... 5/636
5,907,876 A * 6/1999 Schwabe ..... 5/636

* cited by examiner

*Primary Examiner*—Peter R. Brown
(74) *Attorney, Agent, or Firm*—Banner & Witcoff, Ltd.

(57) ABSTRACT

A head supporting device comprises a pair of cushions that are integrally formed with a bridge. The bridge in turn comprises a front sheet extending between the pair of cushions, which defines a head receiving zone for receiving a user's head, and a rear sheet extending between the pair of cushions, the rear sheet in use resting against a seat in which the user is sitting. The pair of cushions, the front sheet and the rear sheet define hinge means, so that as the user's head presses against the front sheet, the cushions are automatically drawn together so as to snugly receive the user's head therebetween. The rear sheet further includes a zipped pocket, which allows the device to be folded and stowed away when not in use.

11 Claims, 6 Drawing Sheets

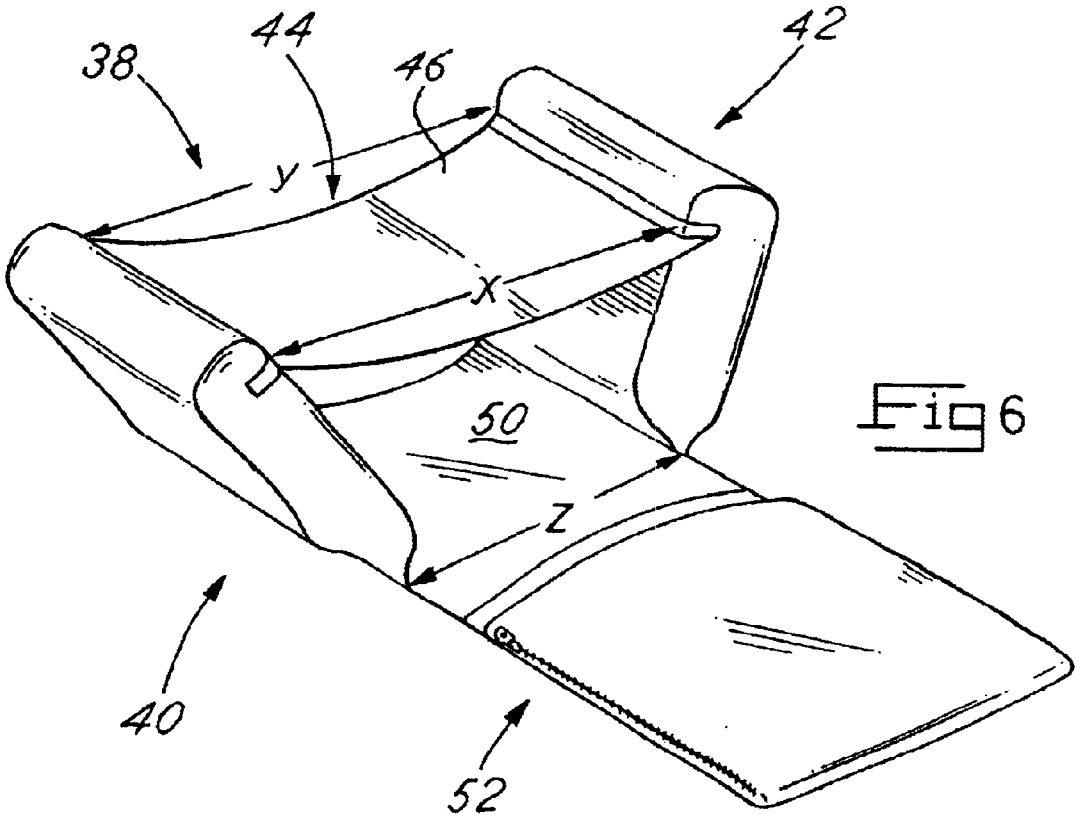
Fig 6
Fig 7
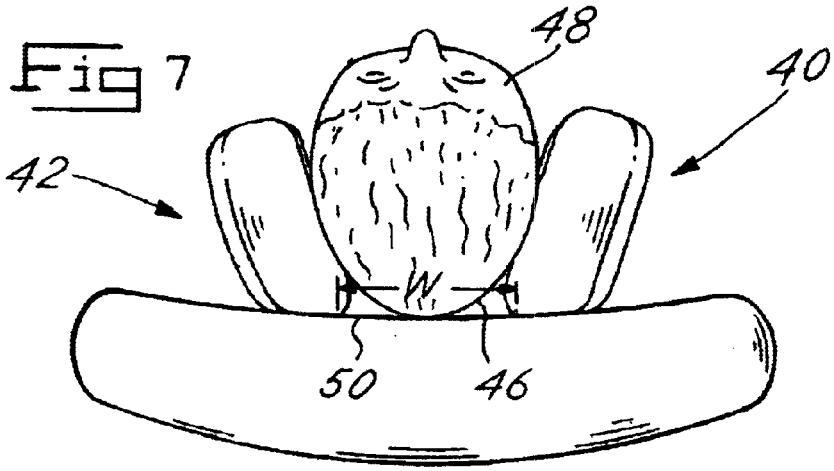

HEAD SUPPORTING DEVICE

CROSS REFERENCE TO RELATED APPLICATION

This is a U.S. national application corresponding to South African Application No. 2001/1015 filed on Feb. 6, 2001, entitled 'A Head Supporting Device', which is incorporated herewith by reference and for which all priority rights are claimed.

BACKGROUND OF THE INVENTION

This invention relates to a head supporting device, and in particular, to a device for supporting the head of a user whilst traveling.

Typical head supporting devices take the form of an inflatable collar, in which the user must inflate the device and then place it around his or her neck with a view to supporting the user's head. These devices generally do not fully support the user's head, as a result of which the head tends to sway sideways. This is clearly uncomfortable for the user, with the user typically not being able to obtain any rest whilst traveling.

It would therefore be desirable to have a head supporting device that can snugly receive and support the whole of a user's head so as to restrain the head from swaying.

SUMMARY OF THE INVENTION

According to the invention, there is provided a head supporting device comprising:

a pair of cushions;

a rear sheet extending between the pair of cushions, the rear sheet in use resting against a seat in which a user is sitting; and a front sheet extending between the pair of cushions, the front sheet defining a flexible and deformable head receiving zone for receiving the user's head;

wherein the pair of cushions, the rear sheet and the front sheet define hinge means, so that as the user's head presses against the front sheet, the cushions are drawn together so as to snugly receive the user's head therebetween.

Typically, the rear sheet comprises an operatively top edge that is narrower than an operatively bottom edge, thereby allowing the cushions to press against the user's head so as to reduce the amount of sideways movement that the head can make.

In the preferred embodiment, the front sheet has an operatively top edge that is wider than an operatively bottom edge, thereby allowing the cushions in use to conform to the shape of the user's head.

In one form of the invention, the rear sheet includes a filler element that is arranged to fit into a space defined between a head rest and a car seat fitted with the head rest, for allowing the device to be used in a motor vehicle.

Advantageously, the rear sheet includes a flap that, in use, extends downwardly past the back and shoulders of the user to allow the weight from the user's back and shoulder area to maintain the device in a fixed position.

Conveniently, the flap of the rear sheet defines a pocket for allowing the device, when not in use, to be folded together and stowed away in the pocket.

Preferably, the cushions are either pillow cushions or inflatable cushions.

In one version of the invention, the device includes a pair of pockets, each pocket being arranged to receive at least one cushion.

Alternatively, the cushions are integrally formed with the rear and front sheets.

BRIEF DESCRIPTION OF THE DRAWINGS

FIG. 6 shows a perspective view of a head supporting device according to a second embodiment of the invention;

FIGS. 7 and 8 show top and side views, respectively, of the device shown in FIG. 6 in use;

DESCRIPTION OF EMBODIMENTS

Figure 1:
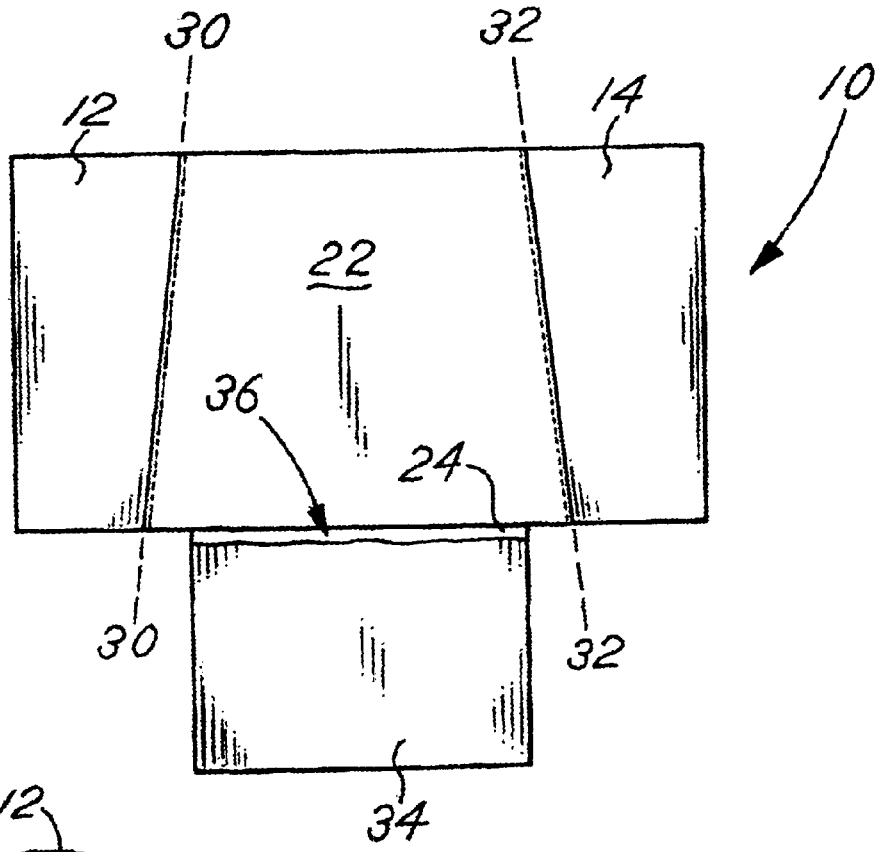
FIG. 1 shows a front view of a head supporting device according to a first embodiment of the invention.
Figure 3:
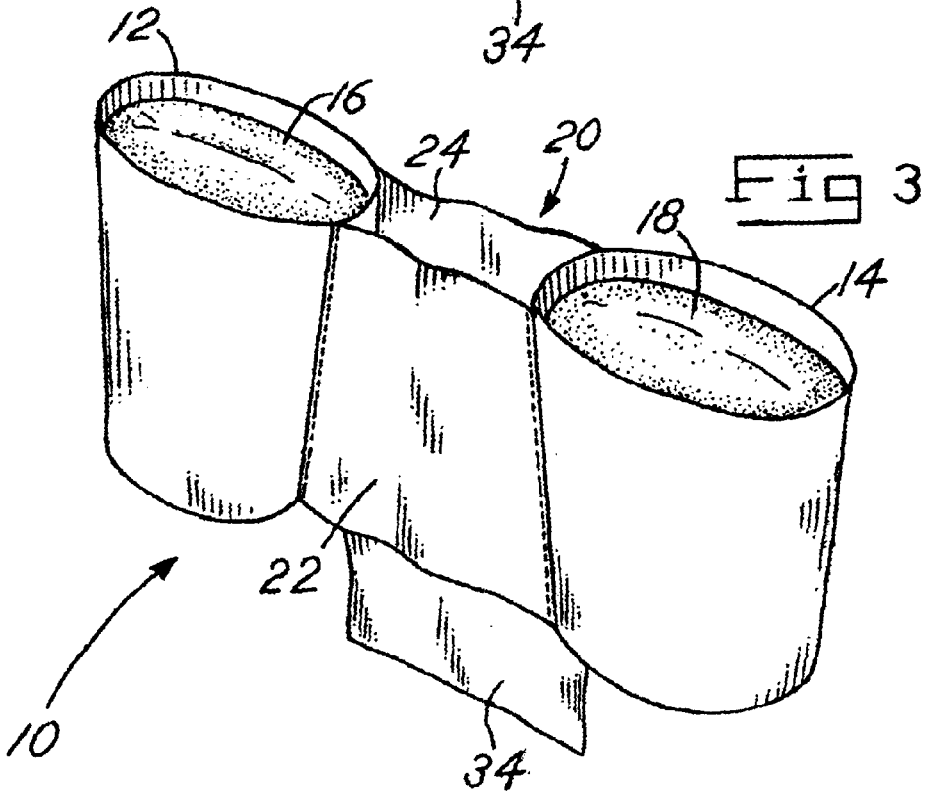
FIG. 3 shows a perspective view of the device shown in FIGS. 1 and 2, wherein a pair of cushions have been inserted into the pockets of the device.
Figure 2:
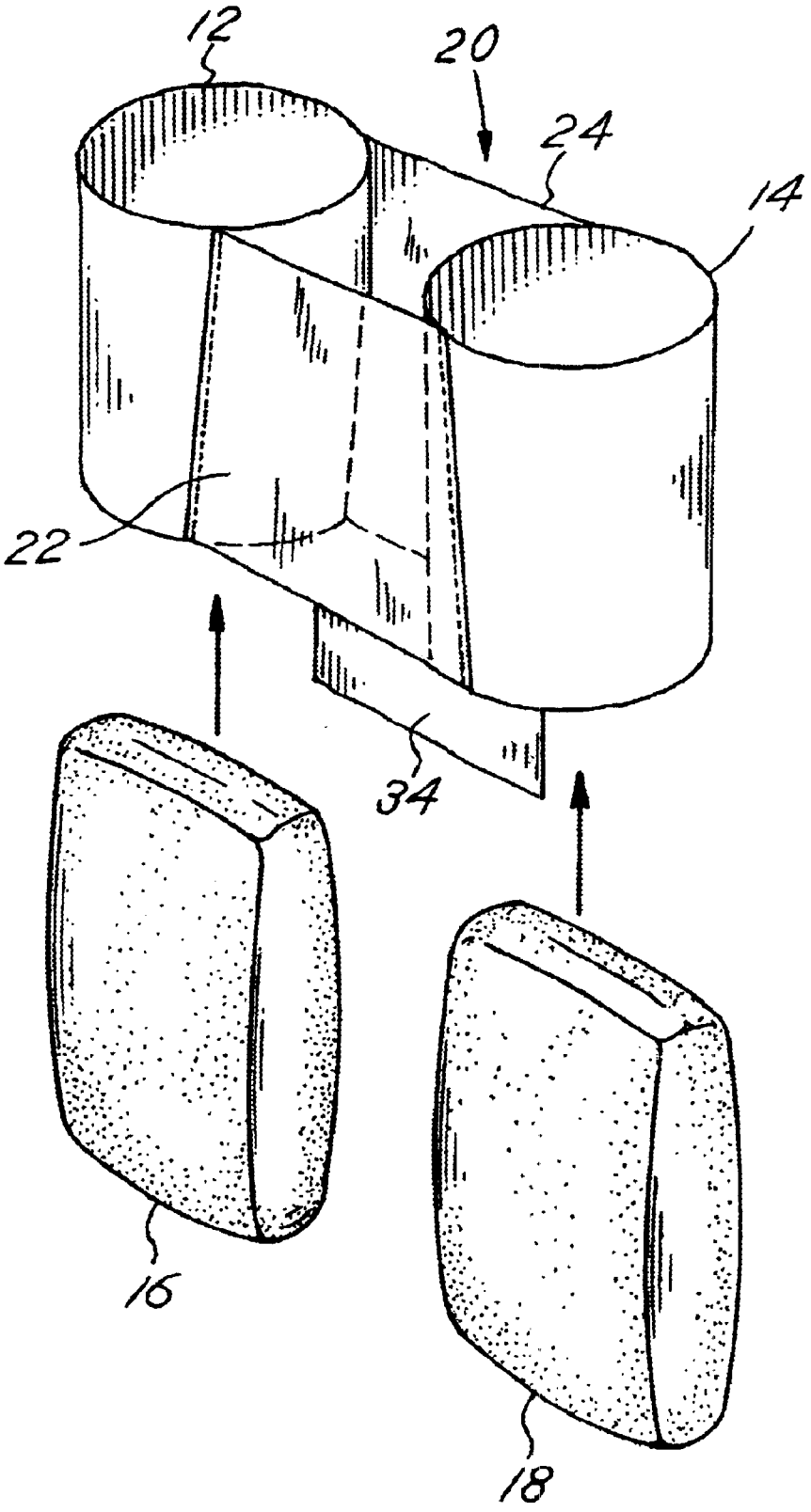
FIG. 2 shows a perspective view of the device shown in FIG. 1, showing, in particular, the pockets of the device in an expanded state for receiving a cushion.
Figure 4:
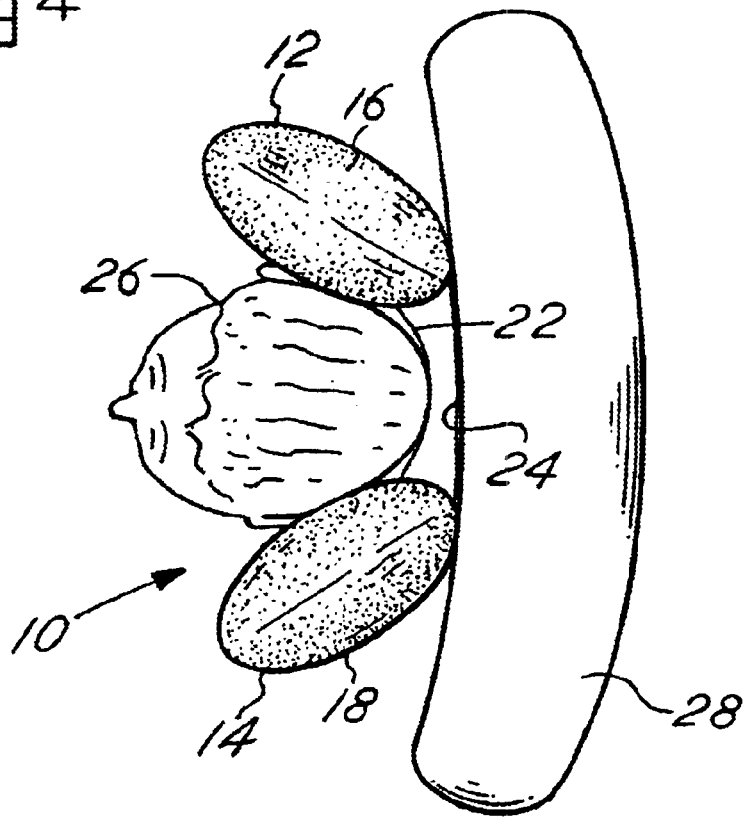
FIGS. 4 and 5 show top and side views, respectively, of the device in use.

Referring to FIGS. 1 to 5, a head supporting device 10 comprises a pair of pockets 12 and 14 for receiving a pair of cushions 16 and 18 respectively. The cushions 16 and 18 may either be pillow cushions or inflatable cushions. A bridge 20 extends between the pair of pockets 12 and 14. The bridge 20 comprises a front sheet 22 and a rear sheet 24. The front sheet 22 defines a head receiving zone for receiving the user's head 26, and the rear sheet 24, in use, rests against the seat 28 in which the user is sitting.

The front and rear sheets 22 and 24 are attached, typically by being stitched, to the front and rear portions of the pockets 12 and 14 respectively. In particular, the front sheet is stitched to the pockets 12 and 14 so as to define axes 30 and 32 respectively. The sheets 22 and 24 and the pockets 12 and 14 are typically made from a suitable fabric, such as cotton, polyester, nylon or any other combination of natural and/or man-made fibre, including plastic.

Significantly, the front sheet 22 is spaced a distance away from the rear sheet 24. This effectively defines a hinge or pivot arrangement, so that as the user's head 26 presses against the front sheet 22, the cushion-filled pockets 12 and 14 simultaneously and automatically pivot around the axes 30 and 32, thereby drawing them together so as to snugly receive the user's head 26. This can be clearly seen in FIGS. 4 and 5. A specific advantage of this feature is that the pockets cover the user's ears, thereby reducing the environmental noise experienced by the user.

The top part or edge of the front sheet 22 is narrower than the bottom part or edge. This allows a reduction in the amount of sideways movement of the user's head 26, thereby making the user more comfortable, and thus facilitating rest.

Figure 5:
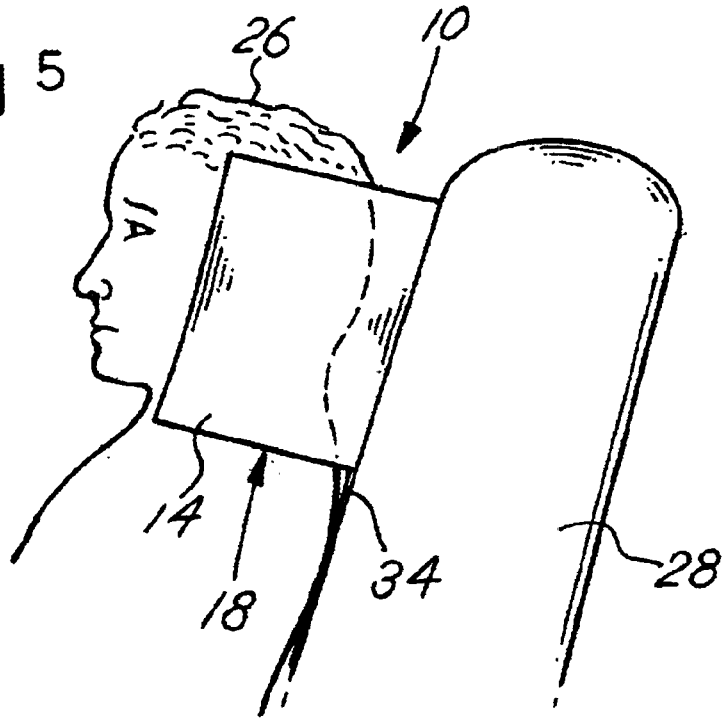

The rear sheet 24 includes a flap 34 that, in use, extends downwardly past the back and shoulders of the user, as can be seen in FIG. 5. The flap 34 allows the weight from the user's back and shoulder area to maintain the device 10 in a fixed position.

The flap 34 itself includes a pocket 36, which allows the device 10 to be folded and stowed away when not in use.

Figure 8:
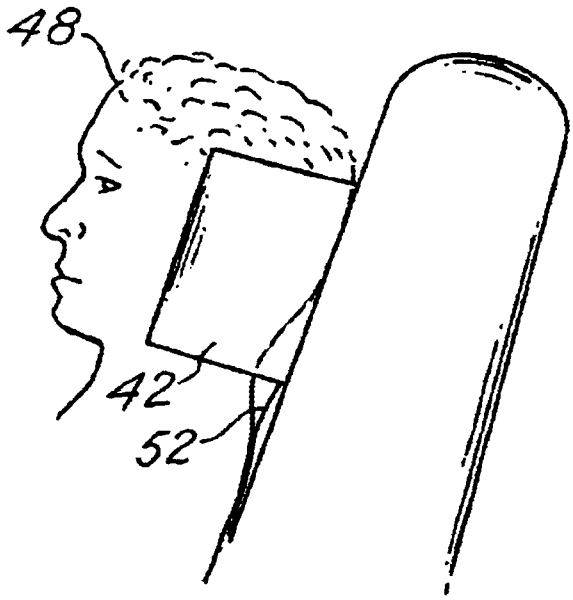

FIGS. 6 to 8 show a head supporting device 38, similar to the device 10 described above, save that a pair of cushions 40 and 42 are integrally formed with a bridge 44. The operation of the device 38 remains substantially the same, with a front sheet 46 of the bridge 44 being arranged to automatically draw the cushions 40 and 42 together as the user's head 48 presses against the front sheet 46. The operation of the device 38 is explained in further detail with reference to FIGS. 11 to 14.

In this version of the invention, the bottom edge of the front sheet 46, indicated by x, is narrower than the top edge, indicated by y. In one embodiment, for example, x=28 cm and y=33 cm. This arrangement is significant in that in the resting position, shown in FIG. 8, the top part of a person's head 48 lies further back than the bottom part of the head 48. As a result, the front sheet 46 has to taper to properly accommodate the person's head.

Significantly though, the rear sheet 50 also tapers. However, the bottom part of the rear sheet 50, indicated by z, is wider than the top part, indicated by w, which is more clearly shown in FIG. 7. In one embodiment, for example, z=22 cm and w=17 cm. The rear sheet 50 governs the final resting position of the device 38 and the person's head 48, with this tapered arrangement ensuring that the top part of each cushion 40 and 42 pushes against the top part of the person's head, so as to stabilize this portion of the head 48.

As indicated above, the rear sheet 50 further includes a zipped pocket 52, which allows the device 38 to be folded and stowed away when not in use, and that also defines a flap for allowing the weight from the user's back and shoulder area to maintain the device 38 in its resting position.

As can be clearly seen in FIG. 6, the front and rear sheets 46 and 50 are attached to the front and rear portions of the cushions 40 and 42 respectively. In addition, and as with the device 10 described above, the cushions 40 and 42 could either be pillow cushions or inflatable cushions.

Figure 9:
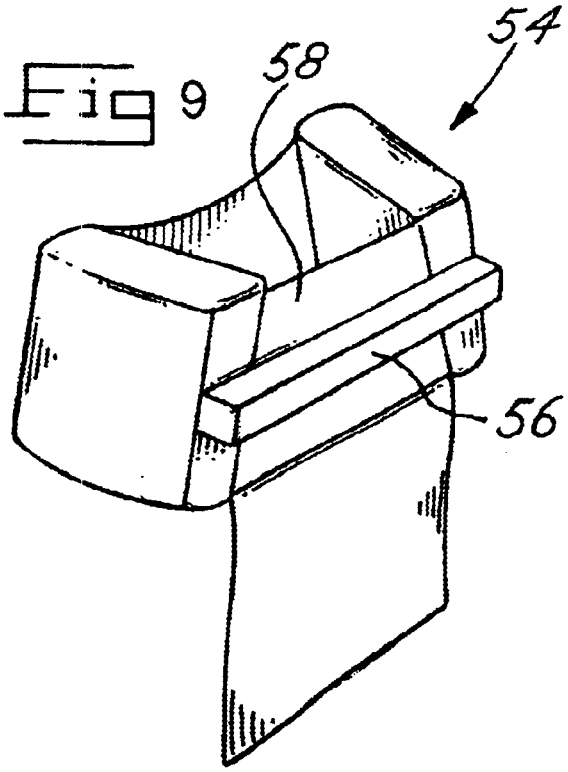
FIG. 9 shows a perspective view of a head supporting device according to a third embodiment of the invention.
Figure 10:
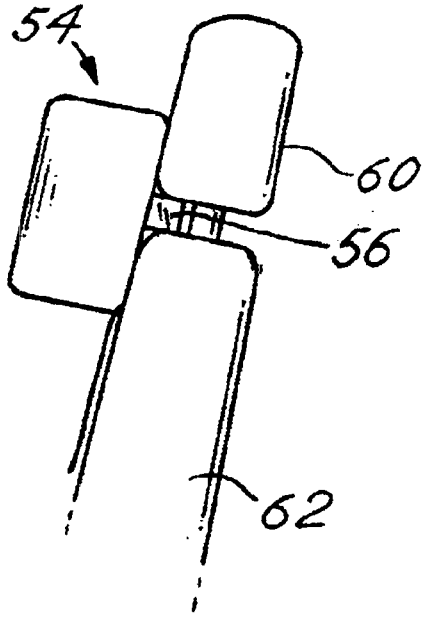
FIG. 10 is a side view of the device.

Turning now to FIGS. 9 and 10, a further version of a head supporting device 54, primarily for use with motor vehicle seats, is shown. The device 54 is substantially as described above with reference to FIGS. 6 to 8, save that a filler element 56 is fitted to a rear sheet 58. The filler element 56 can take the form of either a pillow cushion, including a strip of foam material, or an inflatable cushion. The filler element 56 is attached to the rear sheet with an attachment device, such as Velcro™ and is used to occupy the space defined between a head rest 60 and a car seat 62.

Figure 11:
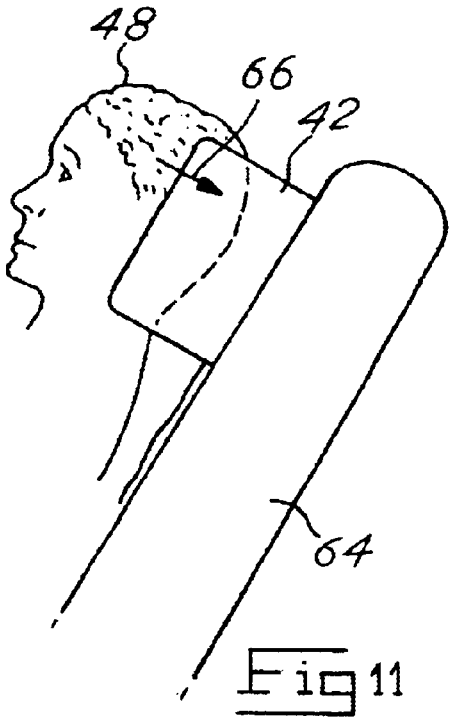
FIGS. 11 and 12 show side and front views of the device when a user's head initially engages the device.
Figure 12:
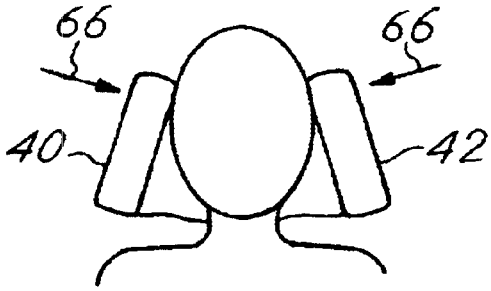
Figure 13:
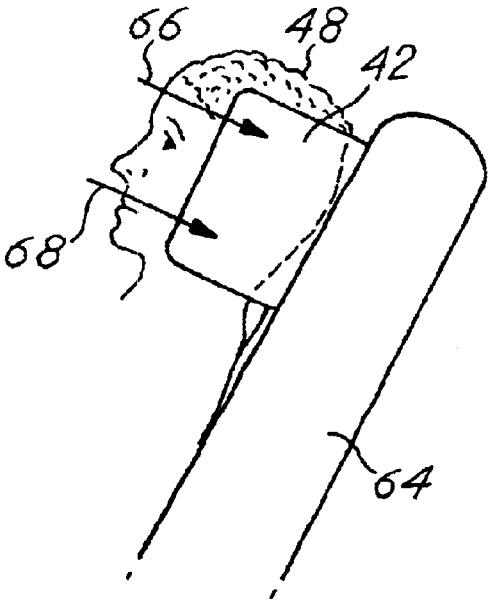
FIGS. 13 and 14 show side and front views of the device in its final resting position in which the user's head is filly nested within the device.
Figure 14:
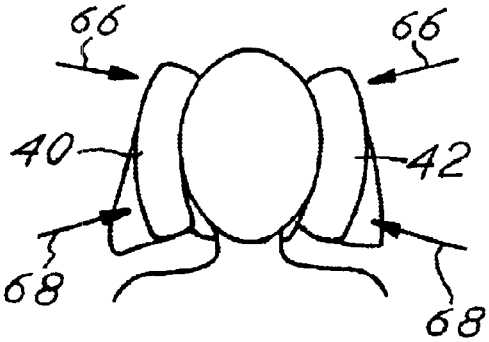

The operation of the device 38, 54 will now be explained with reference to FIGS. 11 to 14, wherein FIGS. 11 and 12 show the configuration of the device as the user's head 48 initially engages or contacts the device 38, 54, whilst FIGS. 13 and 14 show the device's configuration as the user's head 48 is fully nested within the device 38, 54 with the head 48 resting against the seat 64.

As the user's head 48 initially engages or contacts the device 38, 54, a force, indicated by arrow 66 will be exerted on the top part of the front sheet 46, so as to draw the top part of the cushions 40, 42 inwardly. This arrangement restrains the head 48 from lateral movement, as can be clearly seen in FIG. 12. As the user's body and head is pressed against the seat 64, the bottom of the user's head 48 catches the bottom portion of the front sheet 46 thereby creating a force, indicated by arrow 68, which serves to draw the bottom portions of the cushions 40, 42 towards the user's cheek. Thus, in the final resting position, as shown in FIG. 14, the user's head 48 is snugly and securely held between the cushions 40 and 42.

Although the device of the present invention has been described with specific reference to traveling, such as by aeroplane, bus, train or motor vehicles, it has additional applications. For example, the device may be used in medical emergencies in which the head of a victim needs to be kept stationary.

The present invention thus provides a convenient and easy way of supporting a user's head. The construction of the device also ensures that it is relatively robust, thereby allowing it to be used repeatedly.

I claim:

1. A head supporting device comprising:

a pair of spaced apart cushions each of said cushions having a rear portion;

a rear sheet extending between said rear portions of the pair of cushions, the pair of cushions being hingedly fitted to the rear sheet, with the rear sheet in use resting against a seat in which a user is sitting; and a front sheet extending between the pair of cushions, the front sheet defining a flexible and deformable head receiving zone for receiving the user's head, so that as the user's head presses against the front sheet, the cushions are drawn together so as to snugly receive the user's head therebetween.

2. A head supporting device according to claim 1, wherein the rear sheet comprises an operatively top edge that is narrower than an operatively bottom edge, thereby allowing the cushions to press against the user's head so as to reduce the amount of sideways movement that the head can make.

3. A head supporting device according to either one of the preceding claim 1 or 2, wherein the front sheet has an operatively top edge that is wider than an operatively bottom edge, thereby allowing the cushions in use to conform to the shape of the user's head.

4. A head supporting device comprising:

a pair of cushions;

a rear sheet extending between the pair of cushions, the rear sheet in use resting against a seat in which a user is sitting, said rear sheet including a top edge and a bottom edge, said top edge being more narrow than the boffom edge thereby allowing the cushions to press against a user's head and reduce the sideways movement by the head; and a front sheet extending between the pair of cushions, the front sheet defining a flexible and deformable head receiving zone for receiving the user's head, so that as the user's head presses against the front sheet, the cushions are drawn together so as to snugly receive the user's head therebetween.

5. A head supporting device comprising:

a pair of cushions;

a rear sheet extending between the pair of cushions, the rear sheet in use resting against a seat in which a user is sitting; and a front sheet extending between the pair of cushions, the front sheet defining a flexible and deformable head receiving zone for receiving the user's head, so that as the user's head presses against the front sheet, the cushions are drawn together so as to snugly receive the user's head therebetween, said front sheet including a top edge that is wider than the bottom edge and allowing the cushions to conform to the shape of the user's head.

6. A head supporting device according to claim 1, 4 or 5 wherein the rear sheet includes a filler element that is arranged to fit into a space defined between a head rest and a car seat fitted with the head rest, for allowing the device to be used in a motor vehicle.

7. A head supporting device according to claim 1, 4 or 5 wherein the rear sheet includes a flap that, in use, extends downwardly past the back and shoulders of the user to allow the weight from the user's back and shoulder area to maintain the device in a fixed position.

8. A head supporting device according to claim 7, wherein the flap of the rear sheet defines a pocket for allowing the device, when not in use, to be folded together and stowed away in the pocket.

9. A head supporting device according to claim 1, 4 or 5 wherein the cushions are either pillow cushions or inflatable cushions.

10. A head supporting device according to claim 1, 4 or 5 wherein the device includes a pair of pockets, each pocket being arranged to receive at least one cushion.

11. A head supporting device according to claim 1, 4 or 5 wherein the cushions are integrally formed with the rear and front sheets.

* * * * *